US005948357A

United States Patent [19]

Li et al.

[11] Patent Number: 5,948,357

[45] Date of Patent: Sep. 7, 1999

[54] HEAT RESISTANT PAPER INTERLEAVER FOR SHEET METAL

[75] Inventors: Kwong Y. Li, Mahwah, N.J.; Fortunato Patane, Walden, N.Y.; Timothy P. Griffin, Appleton, Wis.; Gregory A. Unser, Appleton, Wis.; Marget C. Mann, Appleton, Wis.

[73] Assignee: International Paper Company, Purchase, N.Y.

[21] Appl. No.: 08/864,779

[22] Filed: May 29, 1997

[51] Int. Cl.[6] ..... B01J 19/00; C23F 11/00; D21H 27/28

[52] U.S. Cl. ..... 422/40; 422/7; 422/8; 162/160; 162/164.4

[58] Field of Search ..... 422/7, 8, 40; 162/160, 162/164.4

[56] References Cited

U.S. PATENT DOCUMENTS

| | | | |
|---|---|---|---|
| 2,755,167 | 7/1956 | Bleakley | 422/8 |
| 2,986,447 | 5/1961 | Raifsnider | 422/8 |
| 3,080,211 | 3/1963 | Fessler | 428/22 |
| 3,341,469 | 9/1967 | Pines | 252/389 |

*Primary Examiner*—Peter Chin
*Assistant Examiner*—Kevin Cronin
*Attorney, Agent, or Firm*—Luedeka, Neely & Graham, P.C.

[57] ABSTRACT

The present invention relates to paper interleavers for sheet metal and, in particular, to a paper interleaver containing catalytically crosslinked polysiloxane capable of withstanding temperatures approaching 200° C. for prolonged periods of time.

2 Claims, No Drawings

HEAT RESISTANT PAPER INTERLEAVER FOR SHEET METAL

FIELD OF THE INVENTION

The present invention relates to paper interleavers for sheet metal and, in particular, to a paper interleaver capable of withstanding temperatures approaching 200° C. for prolonged periods of time.

BACKGROUND OF THE INVENTION

Recent capital expansion and upgrades in sheet metal mills have produced reducing mills which run faster and can take larger reductions in the sheet metal thickness during each pass. These passes are done in rapid succession, building up a high level of thermal energy in the sheet metal which is wound into coils without allowing much heat to dissipate.

According to conventional practice, an interleaver is typically co-wound into the windings of a sheet metal roll between the metal layers. The interleaver remains in contact with the sheet metal up to a week or more until the coil is fed into the cold annealing and pickling line wherein the interleaver is wound out of the coil.

The increased production rates achieved in many sheet metal mills have resulted in wound sheet metal temperatures as high as 200° C. at the point the interleaver is introduced into the coil. At these temperatures, the natural kraft and laminated papers which have been used as interleavers in the past often do not perform satisfactorily, exhibiting thermal degradation and adhesion to the sheet metal which causes clouding or surface roughness on the metal. This adds cost to the process because the metal has to be further processed to remove the surface damage.

Because of these effects, many sheet metal mills have had to either slow down the process or add more oil to cool the sheet metal and to aid in release of the paper from the sheet metal. Each of these options adds cost to the process.

Japanese Patent No. 18199 describes a heat resistant laminated paper for use as an interleaver for sheet metal. The laminated paper contains 0.5 to 5.0 weight percent based on the weight of the pulp of a synthetic resin formed from polyacrylamide, urea and melamine. The heat resistance of the paper may be further improved by adding dicyandiamide to the paper. A significant disadvantage associated with the use of such resins is that they contain or result in release of formaldehyde, which is a respiratory irritant and a possible carcinogen. In addition, the use of dicyandiamide in the United States is restricted due to heath concerns and the material is expensive.

Many types of silicone coatings have been described for application to paper to improve various properties of the paper. U.S. Pat. No. 4,954,554 describes an aqueous polysiloxane emulsion which comprises a polyvinyl alcohol component as an emulsifying agent. The polysiloxane emulsion composition contains an organopolysiloxane bearing silicone-bonded curing radical selected from the group consisting of hydroxyl radicals and olefinic radicals, a polyvinyl alcohol emulsifying agent and water. The radicals of the curable organopolysiloxane include hexenyl radicals. Curing of the organopolysiloxane is achieved using a cross linking agent such as organoxhydrogenpolysiloxane.

U.S. Pat. No. 2,774,674 describes treatment of kraft paper with organopolysiloxanic oils to provide heat resistance and release properties. The organopolysiloxanic oils are prepared as an aqueous dispersion containing a mineral filler, an emulsifier and an alkali salt of an organosilane-triol. The organopolysiloxanic oils are polysiloxanes containing hydrocarbon groups such as alkyl, aryl, or aralkyl groups linked to a silicon atom and have a viscosity at 25° C. between 100 and 1000 centistoke.

U.S. Pat. Nos. 4,190,688 and 3,463,661 describe silicone release coatings which are cured with heat and a catalyst. The '661 patent describes the use of a release coating prepared from polyvinyl alcohol, silicone resin, acetic acid, a wetting agent and a tin octoate catalyst. The '688 patent describes the use of a release coating prepared from a vinyl-containing siloxane polymer having hydroxy end groups. The polysiloxane polymer of the '688 patent is emulsified in water with polyvinyl alcohol with or without an organic solvent and a hydride polysiloxane cross-liking agent is used along with a tin or platinum catalyst at elevated temperatures to cure the coating.

Although the coatings described in the above patents have provided various improvements in paper properties, the high temperatures to which interleavers are exposed in modern sheet metal manufacturing coupled with the increased amount of oil used to address blocking problems has created a need for a further improved economical paper-based interleaver which will perform satisfactorily under these conditions. Standard coated paper grades with silicone-type coatings are relatively expensive and therefore do not adequately address this need, and formaldehyde-containing additives generally will not be accepted for environmental reasons.

SUMMARY OF THE INVENTION

Accordingly, it is an object of the invention to provide a paper interleaver for sheet metal.

Another object of the invention to provide a paper interleaver for sheet metal which can withstand temperatures approaching 200° C. for prolonged periods.

It is also an object of the invention to provide a paper interleaver for sheet metal which exhibits limited adherence to the sheet metal, does not damage or disaffect the metal surface and does not cause the sheet metal to discolor or corrode.

A further object of the invention is to provide a paper interleaver for sheet metal which exhibits good absorbency with respect to residual oil used to cool and lubricate the sheet metal and manufacturing equipment.

An additional object of the invention is to provide a paper interleaver for sheet metal wherein the paper does not require a coating and the manufacture of the paper does not present health risks to workers.

Yet another object of the invention is to provide a paper interleaver of the character described and a method of making the same which is economical and cost effective as compared with conventional interleavers.

With regard to the foregoing and other objects, the invention provides a paper interleaver for placement between layers of sheet metal. The interleaver comprises a porous fibrous web containing from about 0.1 to about 5 weight percent of a catalytically cross-linked polysiloxane dispersed generally through the thickness of the web.

According to another aspect the invention provides a method of making a paper interleaver for placement between layers of sheet metal, said method comprising impregnating a porous fibrous web at a section of a paper making process wherein the web has a moisture content of from about 5 to about 15 weight percent with a polysiloxane/crosslinker emulsion and a polysiloxane/catalyst emulsion and thereafter curing the web to cause the polysiloxanes to cross-link and drying the web whereby a catalytically cross-linked polysiloxane is cured in the web dispersed generally through the thickness of the web.

An additional aspect of the invention comprises a method of storing an elongated sheet of metal at an elevated temperature which comprises winding the sheet metal into a roll to provide spirally wound adjacent layers of sheet metal, co-winding an elongated paper interleaver with the elongated sheet metal so that the paper interleaver is spirally wound in the roll between the adjacent layers of spirally wound sheet metal, wherein the paper interleaver comprises a porous fibrous web containing from about 0.1 to about 5 weight percent interleaver of a catalytically cross-linked polysiloxane dispersed generally through the thickness of the web. A further aspect of the invention is the spirally wound roll of sheet metal with the paper interleaver wound between adjacent layers of sheet metal.

The paper interleaver of this invention withstands temperatures approaching 200° C. for prolonged periods and exhibits reduced adhesion to the sheet metal reducing damage to the surface of the sheet metal associated with use of conventional interleavers. Discoloration and corrosion of the metal is also reduced using the interleaver of the invention. In addition, the interleaver protects the sheet metal from scratching, absorbs residual oil from the sheet metal and provides a means for dissipating the heat of the sheet metal. Also, the manufacture of the paper does not present health risks to workers and the paper can be produced in an economical manner.

DESCRIPTION OF THE INVENTION

This invention provides an improved paper interleaver for wound rolls of sheet metal. The paper interleaver is placed between layers of sheet metal to physically separate the adjacent layers of metal and to protect the metal surfaces when the sheet metal is rolled, cleaned, transported and warehoused.

The paper interleaver is prepared from a porous fibrous web which can be produced using conventional papermaking methods and machines. A wide variety of sources of fibers may be used such as flax, bagasse, esparto, straw, papyrus, bamboo, jute, softwoods, hardwoods, and synthetic fibers. Examples of softwoods include spruce, hemlock, fir and pine. Examples of hardwoods include popular, aspen, birch, maple and oak.

The porous fibrous web is relatively thin, essentially planar or flat and has substantially parallel, oppositely facing surfaces spaced apart by the thickness of the web. Such a web is a three dimensional structure comprised of a network of fibers with interstices therebetween. The fibers can be a mixture of relatively short and relatively long fibers of natural or synthetic origin. Mixtures of natural fibers and synthetic fibers can also be used. Examples of natural fibers include cotton, wool, silk, jute, linen, and the like. Examples of synthetic fibers include rayon, acetate, polyesters (including polyethyleneterephthalate), polyamides (including nylon), acrylics, olefins, aramids, azlons, glasses, modacrylics, novoloids, nytrils, rayons, sarans, spandex, vinal, vinyon, and the like.

The porous fibrous web may additionally include one or more additives. Suitable additives include wet end chemicals, wet strength chemicals, sizes such as rosin size, biocides, thickeners, inhibitors, reinforcing agents, fillers, defoamers, and flame retardants. Combinations of additives may also be used.

Preferred wet strength chemicals are aqueous-based solutions of polyacrylamide, urea, melamine and polyamideepichlorohydrin resin. Preferred wet end chemicals are polyaluminum hydroxychloride, polyaluminum silicate sulfate, aluminum sulfate, bentonite, colloidal silica, soda ash, clay, starch, titanium dioxide, and calcium carbonate. It is noted that fillers may be excluded from paper prepared by the process of the present invention in order to increase the absorbency of the paper.

In accordance with the invention, the porous fibrous web contains a catalyzed polysiloxane dispersed generally throughout the thickness of the web. By "catalyzed crosslinked polysiloxane" it is meant a crosslinked polysiloxane which is produced by impregnating the web substantially uniformly through its thickness with a polysiloxane/crosslinker emulsion and a polysiloxane/catalyst emulsion. The polysiloxane emulsions are applied to the porous fibrous web as a two part system hereinafter referred to as a polysiloxane emulsion system.

Preferably, the polysiloxane/crosslinker emulsion comprises from about 20 to about 50 weight percent of a polysiloxane, from about 0.1 to about 5 weight percent of a hydride polysiloxane cross linking agent, from about 1 to about 5 weight percent of a surfactant, and from about 50 to about 80 weight percent water. A preferred polysiloxane is hexenyl substituted or vinyl substituted such as dimethyl, methyl-hexenyl terminated polysiloxane or vinyl-dimethyl terminated polysiloxane. A preferred surfactant is polyvinyl alcohol (PVA). The hydride polysiloxane cross linking agent is selected from a hydride containing diorganopolysiloxane polymer of 1 to 250 centipoise viscosity at 25° C., a hydride resin composed of monofunctional siloxy units and tetrafunctional siloxy units, or a hydride siloxy resin composed of monofunctional siloxy units, tetrafunctional siloxy units and difunctional siloxy units.

Most preferably, the polysiloxane/crosslinker emulsion comprises from about 35 to about 41 weight percent dimethyl, methyl-hexenyl terminated polysiloxane, from about 0.1 to about 5 weight percent dimethyl, methylhydrogen siloxane, from about 0.1 to about 5 weight percent vinyl alcohol-vinyl acetate copolymer, from about 0.1 to about 5 weight percent polyvinyl alcohol and from about 55 to about 65 weight percent water.

Preferably, the polysiloxane/catalyst emulsion comprises from about 20 to about 50 weight percent of a polysiloxane, from about 0.001 to about 5 weight percent of a catalyst, from about 0.1 to about 5 weight percent surfactant and from about 50 to about 80 weight percent water. Most preferably, the polysiloxane/catalyst emulsion comprises from about 30 to about 40 weight percent dimethyl siloxane, from about 0.1 to about 5 weight percent tetra methyl tetravinyl cyclotetrasiloxane, from about 0.1 to about 5 weight percent vinyl alcohol-vinyl acetate copolymer, from about 0.005 to about 2 weight percent platinum or a platinum-containing catalyst, and from about 55 to about 65 weight percent water.

The platinum or platinum-containing catalyst includes solutions or complexes of chloroplatinic acid in alcohols, ethers, divinylsiloxanes and cyclic vinyl siloxanes. A preferred tin salt of a carboxylic acid is dibutyltindilaurate. It is within the scope of the invention to use a tin salt of a carboxylic acid as a catalyst in place of or in conjunction with the platinum catalyst. Both the platinum and tin catalyst can be activated at elevated temperatures or by radiation.

The viscosity of the polysiloxane emulsion system should be low enough to enable the polysiloxane emulsion system to penetrate the interstices of the porous fibrous web. A preferred viscosity is from about 10 centipoise to about 500 centipoise measured at a shear rate of 10 reciprocal seconds at 25° C. More preferably, the viscosity of the polysiloxane emulsion system is from about 20 to about 100 centipoise.

The polysiloxane emulsion system may carry additives as listed above into the porous fibrous web. An especially preferred additive is a non-volatile inhibitor which limits premature curing of the polysiloxane emulsion system.

The polysiloxane emulsion system is preferably applied to both sides of the porous fibrous web in a manner so as to fully saturate the web at a point in the papermaking process wherein the web has a moisture content of from about 5 to about 15 weight percent. More preferably, the porous fibrous web comprises about 6 to about 9 weight percent of water when the polysiloxane emulsion system is applied.

It is a feature of the invention that the porous fibrous web is impregnated with the polysiloxane emulsion system. As used herein, "impregnate" refers to the substantially complete penetration of the polysiloxane emulsion system into and through the porous fibrous web, and to the distribution of the polysiloxane emulsion system in a preferably substantially uniform, manner in the web. The polysiloxane emulsion system preferably envelopes, surrounds, and/or impregnates individual fibers within the porous fibrous web. The polysiloxane emulsion system is also present on the surface of the porous fibrous web, but is preferably not substantially concentrated on the surface. In this manner, the web is heat stabilized substantially uniformly through its thickness in contrast with a coated web wherein the material is concentrated on the web surfaces as a layer. Applying the material to the web on the papermaking machine prior to the final drying step enables enhanced infusion of the agents into the fiber web because the web is still relatively open and porous and will consolidate and close to a substantial degree in final drying and calendering operations.

The quantity of the polysiloxane emulsion system absorbed and the penetration of the polysiloxane emulsion system in the porous fibrous web depends on the moisture content of the porous fibrous web, the percent solids of the polysiloxane emulsion system, the nip pressure applied to the porous fibrous web, and the viscosity of the polysiloxane emulsion system.

Suitable means of applying the polysiloxane emulsion system on a paper machine are by size press, blade coater and speedsizer. Preferred size press configurations include a flooded nip size press and a metering blade size press. The nip pressure at the size press controls the metering of the polysiloxane emulsion system onto the porous fibrous web. Suitable means of applying the polysiloxane emulsion system on off-machine coating equipment are by rod, gravure roll and air-knife. The polysiloxane emulsion system may also be sprayed directly onto the porous fibrous web or onto rollers which transfer the polysiloxane emulsion system to the porous fibrous web.

In one embodiment of the invention, the impregnation of the porous fibrous web with the polysiloxane emulsion system occurs at the nip point between two rollers. The polysiloxane emulsion system preferably is applied to both rollers but may be applied to only one roller.

Upon exiting the size press, the moisture content of the porous fibrous web which is impregnated with the polysiloxane emulsion system will generally be about 20 to about 40 weight percent water, and will preferably be about 25 to 35 weight percent water. The porous fibrous web is then heated to evaporate water and to cure the polysiloxane emulsion system. Alternatively, or in addition to conventional drying methods, the web impregnated with the polysiloxane emulsion system may be radiation cured.

Once dried and cured, the porous fibrous web impregnated with the cured polysiloxane emulsion system provides an improved paper interleaver. The weight of the paper interleaver is preferably from about 15 to about 45 pounds per 3,000 square feet of paper. More preferably, the weight of the paper interleaver is from about 30 to about 35 lbs/3,000 $ft^2$ of paper. The amount of the polysiloxane emulsion system in the paper interleaver after final drying and calendaring is preferably from about 0.5 to about 5 weight percent based on the total weight of the paper. It is within the scope of the invention to have greater than 5 weight percent of the polysiloxane emulsion system in the paper interleaver in order to achieve acceptable heat resistance, however, such higher amounts may not be cost effective. More preferably, the polysiloxane emulsion system is present in the paper interleaver after final drying and calendaring in an amount of from about 1.5 to about 3.5 weight percent based on the total weight of the paper.

The paper interleaver of the invention withstands temperatures approaching 200° C. without charring or depositing materials on the sheet metal. The paper interleaver protects sheet metal and prevents metal to metal contact which may result in scratching or deformation of the sheet metal. The paper interleaver also exhibits improved absorption of residual oil used as a lubricant in the manufacturing of sheet metal. Residual oil on the sheet metal is disadvantageous because the oil leaves a white residue on the sheet metal.

The following nonlimiting examples illustrate further aspects of the invention.

EXAMPLE 1

Coatings were applied by means of a wire wound rod to a 30# unbleached MF neutral sheet of paper made from 20% hardwood and 80% softwood which contained 0.5% alum, 0.4% rosin size, and 0.1% soda ash. The coatings were applied to the paper samples after final drying and calendaring of the paper. The samples and coating compositions are identified in Table I.

TABLE I

| Sample | Coating Composition |
|---|---|
| 1 | 1% solution of polyacrylamide (0.4 lbs./3000 $ft^2$). |
| 2 | 1% solution of polyacrylamide + 0.5% solution of dicyandiamide mixed at a 1:10 weight ratio, respectively (total chemical wt. 0.7 lbs./3000 $ft^2$). |
| 3 | 1% solution of polyacrylamide + 0.5% solution of dicyandiamide mixed at a 1:10 weight ratio, respectively (total chemical wt. 1.2 lbs./3000 $ft^2$). |
| 4 | 1% of a solution containing 7% by wt. polyacrylate (1.3 lbs./3000 $ft^2$). |
| 5 | 1% of a solution containing 10% by wt. polyacrylate (1.3 lbs./3000 $ft^2$). |
| 6 | 1% of a solution containing 10% by wt. of polyacrylate + 0.5% solution of dicyandiamide (total chemical wt. 1.0 lbs./3000 $ft^2$). |

Each sample was sandwiched between two stainless steel plates of a Carver Model 2518 press at a temperature of 200° C. and a pressure of 350 psi for 24 hours and the release property was determined. The samples were tested with and without being saturated with mineral oil which was applied by dipping the samples into the oil.

All of the samples (both with and without mineral oil) stuck significantly to the steel plates of the press and the paper became discolored (charred) and brittle. Thus, these coatings did not provide acceptable release properties.

EXAMPLE 2

The heat stability/release properties of several paper samples were evaluated. Sample 1 was a 30# unbleached MF neutral sheet of paper made from 20% hardwood and 80% softwood which contained 0.5% alum, 0.4% rosin size, and 0.1% soda ash. Samples 2 and 3 were 30# unbleached MF neutral sheets of paper made from 20% hardwood and 80% softwood which contained 0.5% alum, 0.4% rosin size, 0.1% soda ash, and 1% polyacrylamide. Samples 1–3 were not coated with dicyandiamide. Sample 4 was similar to Sample 3 but was coated with a 2.5% solution of dicyandiamide by means of a wire wound rod. The polyacrylamide in Samples 2, 3 and 4 was added as a wet end chemical in the papermaking process. The samples are identified in Table II. (Reel 1 and Reel 2 refer to different reels of paper.)

TABLE II

| Sample | Paper Interleaver | Coating |
|---|---|---|
| 1 | 30# MF unbleached paper | No Coating |
| 2 | 30# MF unbleached paper having 1 wt. % polyacrylamide (reel 1) | No Coating |
| 3 | 30# MF unbleached paper having 1 wt. % polyacrylamide (reel 2) | No Coating |
| 4 | 30# MF unbleached paper having 1 wt. % polyacrylamide (reel 2) | dicyandiamide |

The release properties for Samples 1–4 with and without mineral oil were determined by the procedure set forth in Example 1. The test results are summarized in Table III.

TABLE III

| Sample | Release (w/o oil) | Color/ Charring (w/o oil) | Release (w/oil) | Color/ Charring (w/oil) |
|---|---|---|---|---|
| 1 | Stuck to steel plate (worst one) | Some | Stuck to steel plate | Some |
| 2 | Stuck slightly to steel plate | Some | Stuck slightly to steel plate | Some |
| 3 | Stuck slightly to steel plate | Some | Stuck slightly to steel plate | Some |
| 4 | Stuck slightly to steel plate | Some | Stuck slightly to steel plate | Some |

The test results in Table III show that all of the samples stuck to the steel plates of the press and the paper became discolored (charred). The presence of mineral oil did not prevent the samples from sticking to the steel plates.

EXAMPLE 3

The release properties of several paper samples were evaluated. Sample 1 was 30# unbleached MF neutral sheet of paper made from 20% hardwood and 80% softwood which contained 0.5% alum, 0.4% rosin size, 0.1% soda ash, and 1% polyacrylamide. Samples 2–6 were 30# unbleached MF neutral paper made from 20% hardwood and 80% softwood which contained 0.5% alum, 0.4% rosin size, and 0.1% soda ash.

A coating was applied to Samples 2–6 with a wire wound rod after final drying and calendaring of the paper. The coating compositions are listed in Table IV. Sample 5 was coated with a polysiloxane/crosslinker emulsion (40% solids) and a polysiloxane/catalyst emulsion (40% solids) which are commercially available under the trademarks SYL-OFF 1171 and SYL-OFF 1171A, respectively, from Dow Corning in Midland, Mich. Sample 6 was coated with a polysiloxane/crosslinker emulsion and a polysiloxane/catalyst emulsion which are commercially available under the trademarks SYL-OFF 7910 and SYL-OFF 7924, respectively, from Dow Corning in Midland, Mich. The emulsions are described in Table IV.

TABLE IV

| Sample | Coating Composition |
|---|---|
| 1 | 2.5% solution of dicyandiamide (1.5 lbs./3000 $ft^2$). |
| 2 | 2.5% solution of dicyandiamide + 22% solution of polyacrylamide mixed at a 10:1 weight ratio, respectively (total chemical wt. 1.75 lbs./3000 $ft^2$). |
| 3 | Polystyrene latex + urea formaldehyde + water in a weight ratio of 2 0:8:72, respectively (total chemical wt. 1.5 lbs./3000 $ft^2$). |
| 4 | Polystyrene latex + polysiloxane/ crosslinker emulsion + water in a weight ratio of 20:4:76, respectively (total chemical wt. 1.5 lbs./3000 $ft^2$). |
| 5 | Polysiloxane/crosslinker emulsion and a polysiloxane/tin catalyst emulsion + water in a weight ratio of 18:2:80, respectively (total chemical wt. 1.75 lbs./3000 $ft^2$). |
| 6 | Polysiloxane/crosslinker emulsion and a polysiloxane/platinum catalyst emulsion + water in a weight ratio of 15:1:84, respectively (total chemical wt. 1.75 lbs./3000 $ft^2$). |

Each sample was sandwiched between two stainless steel plates of a Carver Model 2518 press at a temperature of 180° C. and a pressure of 850 psi for 14 hours and the release properties and degree of charring were determined. The samples were tested with and without being saturated with mineral oil. The test results are summarized in Table V.

TABLE V

| Sample | Release w/oil | Color Charring w/oil | Release w/oil | Color/ Charring w/oil |
|---|---|---|---|---|
| 1 | Poor | Acceptable | Poor | Good |
| 2 | Poor | Acceptable | Poor | Acceptable |
| 3 | Acceptable | Poor | Acceptable | Poor |
| 4 | Acceptable | Good | Acceptable | Good |
| 5 | Good | Good | Good | Good |
| 6 | Good | Good | Good | Acceptable |

Release Properties:

Poor = stuck to steel plate, fibers left on plate;

Acceptable = removed from steel plate with use of razor blade, no fibers left;

Good = removed from steel plate after starting corner with razor blade.

Color/Charring Properties:

Poor = high degree of darkening of fibers, very brittle;

Acceptable = some darkening of fibers, some brittleness;

TABLE V-continued

| Sample | Release w/oil | Color Charring w/oil | Release w/oil | Color/ Charring w/oil |
|---|---|---|---|---|
| Good = | | | minimal darkening of fibers and minimal loss of strength of paper. | |

The test results in Table V show that Samples 5 and 6 which were coated with a platinum or tin catalyst containing polysiloxane emulsion did not stick to the steel. It is important to note that the polysiloxane emulsion in Samples 5 and 6 was applied as a coating after final drying and calendaring of the paper. The other samples coated with dicyandiamide; dicyandiamide and polyacrylamide; polystyrene latex, urea formaldehyde; polystyrene latex and polysiloxane emulsion, respectively, stuck to the steel plates and exhibited unacceptable charring.

EXAMPLE 4

The release properties of several paper samples were evaluated. Sample 1 was a 25.8# commercially available unbleached MF neutral paper made with dicyandiamide. Sample 1 was not coated. Sample 2 was a 30# unbleached MF neutral paper made from 20% hardwood and 80% softwood which contained 0.5% alum, 0.4% rosin size, 0.1% soda ash, and 1% polyacrylamide. Samples 3–7 were 30# unbleached MF neutral paper made from 20% hardwood and 80% softwood which contained 0.5% alum, 0.4% rosin size, and 0.1% soda ash. The samples and weight percent coating compositions are listed in Table VI.

TABLE VI

| Sample | Coating Composition |
|---|---|
| 1 | No Coating. |
| 2 | 2.5% solution of dicyandiamide (1.5 lbs./3000 $ft^2$). |
| 3 | 2.5% solution of dicyandiamide + 22% solution of polyacrylamide mixed at a 10:1 weight ratio, respectively (total chemical wt. 1.75 lbs./3000 $ft^2$). |
| 4 | Polystyrene latex + urea formaldehyde + water in a weight ratio of 20:8:72, respectively (total chemical wt. 1.5 lbs./3000 $ft^2$). |
| 5 | Polystyrene latex + polysiloxane/crosslinker emulsion + water in a weight ratio of 20:4:76, respectively (total chemical wt. 1.5 lbs./3000 $ft^2$). |
| 6 | Polysiloxane/crosslinker emulsion + polysiloxane/tin catalyst emulsion + water in a weight ratio of 18:2:80, respectively (total chemical wt. 1.75 lbs./3000 $ft^2$). |
| 7 | Polysiloxane/crosslinker emulsion + polysiloxane/platinum catalyst emulsion + water in a weight ratio of 15:1:84, respectively (total chemical wt. 1.75 lbs./3000 $ft^2$). |

Each sample was sandwiched between two stainless steel plates of a Carver Model 2518 press at a temperature of 180° C. and a pressure of 850 psi for 14 hours and the release property and degree of charring were determined. The samples were tested with and without being saturated with mineral oil. The test results are summarized in Table VII.

TABLE VII

| Sample | Release (w/o oil) | Color/ Charring (w/o oil) | Release (w/oil) | Color/ Charring (w/oil) |
|---|---|---|---|---|
| 1 | Good | Good | Fair | Fair |
| 2 | Fair | Poor | Poor | Poor |
| 3 | Fair | Fair | Poor | Poor |
| 4 | Poor | Poor | Fair | Poor |
| 5 | Good | Good | Very good | Very good |
| 6 | Poor | Fair | Very good | Good |
| 7 | Fair | Poor | Fair | Fair |

Paper was prepared as above and coated with the coating compositions for Samples 5–7 and evaluated in a Carver Model 2518 press at a temperature of 190° C. and a pressure of 850 psi for 24 hours and the release property and degree of charring were determined. The samples were tested with and without being saturated with mineral oil. The test results are summarized in Table VIII.

TABLE VIII

| Sample | Release (w/oil) | Color/ Charring (w/oil) | Release (w/oil) | Color/ Charring (w/oil) |
|---|---|---|---|---|
| 5 | Good | Good | Very good | Very good |
| 6 | Poor | Fair | Very good | Good |
| 7 | Fair | Poor | Fair | Fair |

The test results in Tables VII and VIII show that paper samples coated with the polysiloxane/crosslinker emulsions and polysiloxane/catalyst emulsions outperformed the other coated samples and exhibited good release properties without charring at a press temperature of 180° C. for 14 hours. However at a press temperature of 190° C. for 24 hours, the paper samples coated with the polysiloxane/crosslinker emulsions and polysiloxane/catalyst emulsions stuck somewhat to the steel plates and exhibited some charring.

EXAMPLE 5

The release properties of coated paper samples were evaluated. Sample 1 was 30# unbleached MF neutral paper made from 20% hardwood and 80% softwood and contained 0.5% alum,0.4% rosin size, 0.2% polyacrylamide, and 0.5% dicyandiamide, based on fiber weight. In Sample 1, the polyacrylamide and dicyandiamide were added at the size press in the papermaking process. Samples 2 and 3 were 30# unbleached MF neutral paper made from 20% hardwood and 80% softwood and contained 0.5% alum, and 0.4% rosin size, based on fiber weight. Coatings which are described in Table IX were applied to Samples 2 and 3 on a pilot plant size press.

TABLE IX

| Sample | Coating Composition |
|---|---|
| 1 | No Coating |
| 2 | Polysiloxane/crosslinker emulsion + polysiloxane/tin catalyst emulsion + water in a weight ratio of (18:2:80) to provide a total chemical wt. on paper of 0.6 lbs./3000 $ft^2$. |
| 3 | Polysiloxane/crosslinker emulsion + polysiloxane/platinum catalyst |

TABLE IX-continued

| Sample | Coating Composition |
|---|---|
| | emulsion + water in a weight ratio of (15:1:84) to provide a total chemica1 wt. on paper of 0.6 lbs./3000 $ft^2$. |

Each of the paper samples was interleaved into at least one stainless steel coil following the last reduction pass at a rolling mill. The temperature of the steel was raised higher than normal to subject the paper to temperature conditions as hot as possible.

After 18 hours, the paper was wound out at the cold annealing & pickling line. The release properties of coated paper samples were evaluated. The test results are summarized in Table X.

TABLE X

| Sample | Temp. of Steel When Paper is Interleaved | Paper Stick to Steel | Other Comments |
|---|---|---|---|
| 1 | 107° C. | No | Very brittle, many breaks in paper while unwinding steel. |
| 1 | 127° C. | No | Very brittle, many breaks in paper while unwinding steel. |
| 2 | 127° C. | No | Brittleness, some breaks in paper while unwinding steel. |
| 3 | 138° C. | No | Brittleness, some breaks in paper while unwinding steel. |

The test results in Table XI show that the paper coated with the polysiloxane/crosslinker emulsions and polysiloxane/catalyst emulsions and the uncoated paper manufactured with polyacrylamide and dicyandiamide did not stick to the steel plates at temperatures of 107° C. to 138° C. However, the uncoated paper manufactured with dicyandiamide and polyacrylamide exhibited excessive brittleness.

EXAMPLE 6

The release properties of three different paper samples were evaluated. Sample 1 was 30# unbleached MF neutral paper made from 20% hardwood and 80% softwood which contained 0.5% alum, 0.4% rosin size, and 0.3% polydimethylsiloxane emulsion without a catalyst. The weight percentages are based on fiber weight. The polydimethylsiloxane emulsion was applied to both sides of the porous fibrous web in Sample 1 in the papermaking process after the first dryer unit and prior to the size press.

Sample 2 was 30# unbleached neutral extensible paper having microcrepes which was made from 20% hardwood and 80% softwood which contained 0.5% alum, 0.4% rosin size, and 0.3% polydimethylsiloxane emulsion without a catalyst. The weight percentages are based on fiber weight. The polydimethylsiloxane emulsion was applied to one side of the porous fibrous web in Sample 2 in the papermaking process after the first dryer unit and prior to the size press.

Sample 3 was the same as Sample 1 except that the polydimethylsiloxane emulsion was applied to only one side of the porous fibrous web.

The paper samples were wound into a steel coil following the last pass at the reducing mill. The temperature of the steel is listed in Tables XII and XIII. After approximately 20 hours, each of the paper samples was wound out at the cold annealing and pickling line and evaluated. Additional mineral oil was applied to some steel coils for the first evaluation but not for the second evaluation. The test results for the first evaluation are summarized in Table XII and for the second evaluation in Table XIII.

TABLE XII

| Sample | Steel Temp. as Paper is Interleaved | Paper Sticking to Steel | Other Comments |
|---|---|---|---|
| 1 | 152° C. | No | Extra oil at reducing mill used to aid release. |
| 1 | 124° C. | No | Paper was slightly brittle, a few breaks. |
| 2 | 171° C. | Yes | Failure—paper stuck to steel plus very brittle. |
| 2 | 132° C. | No | Extra oil at reducing mill used to aid release. |
| 3 | 149° C. | No | Extra oil at reducing mill used to aid release. |
| 3 | 143° C. | No | Paper did not stick to steel and no break. |

TABLE XIII

| Sample | Steel Temp. as Paper is Interleaved | Paper Sticking to Steel | Other Comments |
|---|---|---|---|
| 1 | 132° C. | Yes | Failure—paper stuck to steel. |
| 1 | 116° C. | No | OK |
| 2 | 141° C. | Yes | Failure—paper stuck to steel for most of coil. |
| 2 | 110° C. | No | OK |
| 3 | 121° C. | No | OK |
| 3 | 138° C. | Yes | Failure—paper stuck to steel and was brittle. |

The test results in Tables XII and XIII show that paper made by applying a noncatalyst containing polydimethylsiloxane emulsion to the porous fibrous web in the papermaking process does not provide heat resistance at temperatures above 141° C. It is noted that the addition of extra mineral oil to the steel coils in the first evaluation aided in release of the paper from the steel but did not completely eliminate sticking of the paper to the steel.

EXAMPLE 7

The release properties of five different paper samples were evaluated. Sample 1 was 30# unbleached MF neutral paper made from 20% hardwood and 80% softwood which contained 0.5% alum, 0.4% rosin size, and 0.3% polydimethylsiloxane emulsion without a catalyst which was applied to both sides of the porous fibrous web in the papermaking process after the first dryer unit and prior to the size press. The weight percentages are based on fiber weight.

Sample 2 was a 25.8# unbleached MF neutral commercially available paper manufactured with dicyandiamide.

Sample 3 was 30# unbleached MF neutral paper made from 20% hardwood and 80% softwood which contained 0.5% alum, 0.4% rosin size, and 1.0% polysiloxane/crosslinker emulsion and polysiloxane/platinum catalyst emulsion which was applied to both sides of the porous fibrous web in the papermaking process after the first dryer unit and prior to the size press. The weight percentages are based on fiber weight.

Sample 4 was 30# unbleached MF neutral paper made from 20% hardwood and 80% softwood which contained 0.5% alum, 0.4% rosin size, and 1.0% polysiloxane/crosslinker emulsion and polysiloxane/platinum catalyst emulsion which was applied to both sides of the porous fibrous web in the papermaking process at the size press. The weight percentages are based on fiber weight.

Sample 5 was 30# unbleached MF neutral paper made from 20% hardwood and 80% softwood which contained 0.5% alum, 0.4% rosin size, and 3.3% polysiloxane/crosslinker emulsion and polysiloxane/platinum catalyst emulsion which was applied to both sides of the porous fibrous web in the papermaking process at the size press. The weight percentages are based on fiber weight.

The release and charring properties of the paper samples were evaluated. Each paper sample was placed in a hot press at a temperature of 200° C. and a pressure of 850 psi for 24 hours. Each paper sample was tested with and without being saturated with mineral oil. The test results for two evaluations are summarized in Tables XIII and XIV.

TABLE XIII

| Coating | Release (w/oil) | Color/Charring w/oil) | Release (w/o oil) | Color/Charring (w/o oil) |
|---|---|---|---|---|
| 1 | very good | good | good | good |
| 1 | very good | fair | good | fair |
| 2 | very good | good | very good | good |
| 2 | very good | good | very good | good |
| 3 | good | fair | very good | good |
| 3 | very good | fair | very good | good |
| 4 | very good | good | very good | good |
| 4 | very good | good | very good | good |
| 5 | very good | good | very good | good |
| 5 | very good | good | very good | good |

TABLE XIV

| Coating | Release (w/oil) | Color/Charring w/oil) | Release (w/o oil) | Color/Charring (w/o oil) |
|---|---|---|---|---|
| 1 | good | good | good | good |
| 1 | good | good | good | fair |
| 2 | good | good | good | good |
| 2 | very good | fair | good | good |
| 3 | good | good | fair | good |
| 3 | good | fair | good | good |
| 4 | good | fair | fair | fair |
| 4 | good | fair | good | good |
| 5 | very good | fair | good | good |
| 5 | good | fair | good | good |

The test results in Tables XIV and XV show that the paper samples impregnated in the papermaking process with the polysiloxane/crosslinker emulsion and polysiloxane/platinum catalyst emulsion provided very good release properties and resisted charring much more consistently than the uncoated paper samples or paper samples impregnated with a polydimethylsiloxane emulsion without a catalyst. Moreover, the paper samples impregnated in the papermaking process with the polysiloxane/crosslinker emulsion and polysiloxane/platinum catalyst emulsion did not require additional mineral oil in order to exhibit very good release from the steel plates. No significant difference was observed between the paper samples containing the different amounts of polysiloxane/crosslinker emulsion and polysiloxane/platinum catalyst emulsion.

EXAMPLE 8

Samples 4 and 5 from Example 7 which were impregnated with the polysiloxane/crosslinker emulsion and polysiloxane/platinum catalyst emulsion were wound into spirally wound steel coils following the last pass at the reducing mill and evaluated for release and brittleness. The paper samples remained in the coil for about 20 hours before being wound out at the cold annealing and pickling line. No additional lubricating oil was applied to the coils prior to contact with the paper samples. The test results are summarized in Table XV.

TABLE XV

| Sample | Steel Temp. as Paper is Interleaved | Paper Sticking to Steel | Other Comments |
|---|---|---|---|
| 4 | 160° C. | No | Brittle paper, many breaks at cold A&P |
| 4 | 160° C. | No | Brittle paper, many breaks at cold A&P |
| 4 | 166° C. | Yes | Failure—paper stuck to steel |
| 5 | 149° C. | No | OK |
| 5 | 166° C. | No | Brittle paper, many breaks at cold A&P |

The test results in Table XV show that Sample 5 which was impregnated in the papermaking process with the polysiloxane/crosslinker emulsion and polysiloxane/platinum catalyst emulsion in an amount of 3.3 weight percent did not stick to the steel plates even at a temperature as high as 166° C. Moreover, Sample 5 did not give any indication that it would stick to the steel even at higher temperatures.

Sample 4 which was impregnated in the papermaking process with the polysiloxane/crosslinker emulsion and polysiloxane/platinum catalyst emulsion in an amount of 1.0 weight percent did not stick to the steel plates at a temperature of 160° C. but did stick to the steel plates at a temperature of 166° C. It is noted that a temperature of greater than 166° C. could not be attained for these particular steel plates.

While the invention has been described with particular reference to certain embodiments thereof, it will be understood that changes and modifications may be made by those of ordinary skill in the art within the scope and spirit of the following claims.

What is claimed is:

1. A method of storing an elongated sheet of metal at an elevated temperature which comprises winding the sheet metal into a roll to provide spirally wound adjacent layers of sheet metal, co-winding an elongated paper interleaver with the elongated sheet metal so that the paper interleaver is spirally wound in the roll between the adjacent layers of spirally wound sheet metal, wherein said paper interleaver comprises a porous fibrous web which after final drying and calendaring has from about 0.5 to about 5 weight percent based on the total weight of the paper interleaver of a catalytically cross-linked polysiloxane dispersed generally through the thickness of the web.

2. A spirally wound roll of sheet metal with a paper interleaver between the layers of sheet metal wherein said paper interleaver comprises a porous fibrous web which after final drying and calendaring has from about 0.5 to about 5 weight percent based on the total weight of the paper interleaver of a catalytically cross-linked polysiloxane dispersed generally through the thickness of the web.

* * * * *

UNITED STATES PATENT AND TRADEMARK OFFICE

CERTIFICATE OF CORRECTION

PATENT NO. : 5,948,357

DATED : September 7, 1999

INVENTOR(S) : Kwong Y. Li, et al.

It is certified that error appears in the above-identified patent and that said Letters Patent is hereby corrected as shown below:

Column 3, line 46 after "include", delete "popular" and insert --poplar--.

Column 7, Table III, lines 38-40, delete the column headings

| | | | | |
|---|---|---|---|---|
| "Sample | Release (w/o oil) | Color/Charring (w/o oil) | Release (w/ oil) | Color/Charring" (w/ oil) |

and replace with the new headings

| | | | | |
|---|---|---|---|---|
| --Sample | Release (w/ oil) | Color/Charring (w/ oil) | Release (w/o oil) | Color/Charring-- (w/o oil). |

Column 8, Table V, lines 47-50, delete the column headings

| | | | | |
|---|---|---|---|---|
| "Sample | Release w/ oil | Color Charring w/ oil | Release w/ oil | Color/Charring" w/ oil |

and replace with the new headings

| | | | | |
|---|---|---|---|---|
| --Sample | Release w/ oil | Color Charring w/ oil | Release w/o oil | Color/Charring-- w/o oil. |

Column 10, Table VII, lines 3-5, delete the column headings

| | | | | |
|---|---|---|---|---|
| "Sample | Release (w/o oil) | Color/ Charring (w/o oil) | Release (w/ oil) | Color/Charring" (w/ oil) |

and replace with the new headings

| | | | | |
|---|---|---|---|---|
| --Sample | Release (w/ oil) | Color/ Charring (w/ oil) | Release (w/o oil) | Color/Charring-- (w/o oil). |

UNITED STATES PATENT AND TRADEMARK OFFICE

CERTIFICATE OF CORRECTION

PATENT NO. : 5,948,357

DATED : September 7, 1999

INVENTOR(S) : Kwong Y. Li, et al.

It is certified that error appears in the above-identified patent and that said Letters Patent is hereby corrected as shown below:

Column 10, Table VIII, lines 23-25, delete the column headings

| "Sample | Release (w/ oil) | Color/ Charring (w/ oil) | Release (w/o oil) | Color/Charring-- (w/o oil) |
|---|---|---|---|---|

and replace with the new headings

| --Sample | Release (w/ oil) | Color/ Charring (w/ oil) | Release (w/o oil) | Color/Charring-- (w/o oil). |
|---|---|---|---|---|

Column 12, lines 3, 9, and 48, delete all instances of "XIII" and replace with --XIII-A--.

Column 12, Table XIII, lines 31-33, delete the title "TABLE XIII" and replace with --TABLE XIII-A--.

Column 13, line 30, delete "XIII" and replace with --XIII-B--.

Signed and Sealed this

Fifteenth Day of August, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,948,357

DATED : September 7, 1999

INVENTOR(S) : Kwong Y. Li, et al.

It is certified that error appears in the above-identified patent and that said Letters Patent is hereby corrected as shown below:

Column 13, Table XIII, lines 31 - 33, delete the title "TABLE XIII" and replace with --TABLE XIII-B--.

Column 13, line 60, delete "XV" and replace with --XIII-B--.

Signed and Sealed this

Fifteenth Day of August, 2000

*Attest:*

Q. TODD DICKINSON

*Attesting Officer*

*Director of Patents and Trademarks*